US012465969B2

(12) United States Patent
Mejia-Quinchia et al.

(10) Patent No.: US 12,465,969 B2
(45) Date of Patent: Nov. 11, 2025

(54) METHOD FOR FORMING A METAL CONTAINER WITH A CARRIER RING AND RESULTING CONTAINER

(71) Applicant: BELVAC PRODUCTION MACHINERY, INC., Lynchburg, VA (US)

(72) Inventors: Carlos Andres Mejia-Quinchia, Forest, VA (US); Erika Sheaffer Love, Lynchburg, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 21 days.

(21) Appl. No.: 18/284,286

(22) PCT Filed: Mar. 25, 2022

(86) PCT No.: PCT/US2022/021971

§ 371 (c)(1),
(2) Date: Sep. 26, 2023

(87) PCT Pub. No.: WO2022/212206

PCT Pub. Date: Oct. 6, 2022

(65) Prior Publication Data

US 2024/0166401 A1 May 23, 2024

Related U.S. Application Data

(60) Provisional application No. 63/167,405, filed on Mar. 29, 2021.

(51) Int. Cl.
*B21D 51/38* (2006.01)
*B21D 51/24* (2006.01)
(Continued)

(52) U.S. Cl.
CPC ..... *B21D 51/38* (2013.01); *B65D 1/0246* (2013.01); *B65D 41/08* (2013.01); *B21D 51/24* (2013.01)

(58) Field of Classification Search
CPC .... B21D 51/38; B21D 51/28; B21D 51/2638; B65D 41/08
See application file for complete search history.

(56) References Cited

U.S. PATENT DOCUMENTS 6,010,026 A * 1/2000 Diekhoff ..... B21D 51/40 215/44
8,360,266 B2 * 1/2013 Adams ..... B65D 1/0246 220/604

(Continued)

FOREIGN PATENT DOCUMENTS

EP 0865390 A1 9/1998
WO 2020223501 A1 11/2020

OTHER PUBLICATIONS

International Search Report and Written Opinion for PCT Application No. PCT/US2022/021971, dated Jun. 7, 2022 (9 Pages).

*Primary Examiner* — Jacob J Cigna
(74) *Attorney, Agent, or Firm* — NIXON PEABODY LLP

(57) ABSTRACT

Disclosed is a method for retaining an outsert on a neck. The method includes providing a neck with a sidewall for a metal body. The method further includes forming an outward curl in the metal sidewall. The method further includes sliding a plastic outsert down onto the neck. The plastic outsert has a first inner diameter at a first end that is smaller than a diameter of the neck encompassing the outward curl. The outward curl is configured to flex as the plastic outsert slides down onto the neck to accommodate the first end of the plastic outsert passing over the outward curl. The method further includes retaining the plastic outsert on the neck between a first interference fit at a first interface of the metal (Continued)

sidewall and the plastic outsert and at a second interference fit between a top edge of the plastic outsert and the outward curl.

12 Claims, 7 Drawing Sheets

(51) Int. Cl.
*B65D 1/02* (2006.01)
*B65D 41/08* (2006.01)

(56) References Cited

U.S. PATENT DOCUMENTS

| | | | | |
|---|---|---|---|---|
| 9,227,748 | B2 * | 1/2016 | Nakagawa | B65D 1/0207 |
| 10,040,593 | B2 * | 8/2018 | Ross | B21D 51/2615 |
| 11,059,619 | B2 * | 7/2021 | Hasegawa | B65D 41/0435 |
| 11,148,847 | B2 * | 10/2021 | Bueti | B65D 41/3428 |
| 2007/0051687 | A1 * | 3/2007 | Olson | B65D 41/16 215/44 |

* cited by examiner

METHOD FOR FORMING A METAL CONTAINER WITH A CARRIER RING AND RESULTING CONTAINER

CROSS-REFERENCE TO RELATED APPLICATIONS

This application is a U.S. National Stage entry of International Application No. PCT/US2022/021971, filed Mar. 25, 2022, which claims priority to U.S. Provisional Patent Application No. 63/167,405, filed Mar. 29, 2021, each of which is hereby incorporated by reference herein in its entirety.

FIELD

The present invention relates generally to the field of forming or processing an article, such as a container. More specifically, the invention relates to a method and apparatus for forming a metal container with an outsert, such as a plastic outsert.

BACKGROUND

Plastic containers, such as polyethylene terephthalate (PET) bottles, have a feature known as a carrier ring. The carrier ring serves multiple purposes. According to one purpose, the carrier ring is the primary contact when using a conveyor (such as an air conveyor) to transport the plastic containers through processing lines, such as a manufacturing line or a filling line. The carrier ring slides along a conveyor channel, such as an air conveyor channel. Air forces the plastic containers to glide along the air conveyor channel while the container is suspended by the carrier ring. As an example, the air conveyor channel can transport the plastic bottles from a blow molder or a depalletizer to an infeed of a rinser/filler/capper on a filling line.

The plastic resins used in forming the plastic containers have a high carbon footprint, have limited recyclability, and represent hazards for consumer safety. Brand owners are looking for an environmentally friendly alternative to the plastic containers. Metal containers are a viable alternative. As opposed to the plastic resins, such as PET, polyvinyl chloride (PVC), etc., metal containers are more sustainable and recyclable. Metal containers also are less hazardous for consumer safety because, for example, metal containers do not leach chemicals into liquids contained within the container as compared to plastic. However, metal containers typically do not have carrier rings because of the differences in how metal containers are formed as compared to plastic containers. Metal containers which lack a carrier ring are incompatible with processing lines that have been designed for plastic containers having a carrier ring.

To make metal containers lacking a carrier ring compatible with processing lines designed for plastic containers having a carrier ring, metal containers have been made with an outsert that is formed around the neck of the metal container. Such outserts can include carrier rings. However, the processes involved in making metal containers with outserts and the resulting metal containers with outserts have issues that limit their utility and use. For example, the outsert may not be properly seated and secured to the metal container axially and/or rotationally, which can cause issues during transfer, filling, capping, and consumer use.

Accordingly, these and other issues are solved by the disclosed processes for forming a metal container and/or metal container preform (e.g., neck of a metal container) with an outsert, along with the resulting metal container and/or metal container preform with the outsert.

SUMMARY

One exemplary embodiment of the invention relates to a method of retaining an outsert on a neck. The method includes providing a neck for a metal body, with the neck being formed of a metal sidewall. The method further includes forming an outward curl in the metal sidewall at a first end of the neck. The method further includes sliding a plastic outsert down onto the neck from the first end of the neck. The plastic outsert has a first inner diameter at a first end that is smaller than a diameter of the neck encompassing the outward curl. The outward curl flexes as the plastic outsert slides down onto the neck to accommodate the first end of the plastic outsert passing over the outward curl. The method further includes retaining the plastic outsert on the neck between a first interference fit at a first interface of the metal sidewall and the plastic outsert and at a second interference fit between a top edge at the first end of the plastic outsert and the outward curl.

An aspect of the method includes the forming the outward curl leaving a gap between a tip of the outward curl and the metal sidewall of the neck. A further aspect of the method includes the gap providing clearance for the outward curl to flex to accommodate the first end of the plastic outsert passing over the outward curl as the plastic outsert slides onto the neck. A further aspect of the method includes the gap varying in distance between the tip of the outward curl and the metal sidewall across a thickness of the tip of the outward curl. A further aspect of the method includes the outward curl having a substantially circular profile. A further aspect of the method includes the plastic outsert having a plastic sidewall with a thread that extends from and wraps around the plastic sidewall. A further aspect of the method includes a distance the outward curl extending from the metal sidewall of the neck being substantially equal to a thickness of the plastic sidewall of the plastic outsert. A further aspect of the method includes the plastic outsert having a carrier ring that wraps around the plastic sidewall below the thread. A further aspect of the method includes the retaining the plastic outsert on the neck resulting in a clearance between the metal sidewall of the neck and the first end of the plastic outsert. A further aspect of the method includes the plastic outsert having a second inner diameter at a second end, opposite the first end, that is smaller than the diameter of the neck encompassing the outward curl. A further aspect of the method includes the plastic outsert having a second inner diameter at a second end, opposite the first end, that is larger than the diameter of the neck encompassing the outward curl. A further aspect of the method includes treating the plastic outsert with heat to reduce permanent deformation of the plastic outsert during the sliding the plastic outsert onto the neck. A further aspect of the method includes raising the internal temperature of the plastic outsert to about 60° F. to about 140° F. during the treating the plastic outsert with heat.

A further exemplary embodiment of the invention relates to a system for a neck of a metal body. The system includes a metal sidewall having an outward curl formed in a first end. The outward curl has a first portion that extends away from the metal sidewall and a second portion that curls back toward the metal sidewall. The system further includes a plastic outsert retained on the metal sidewall between a first interference fit at a first interface of the metal sidewall and the plastic outsert and at a second interference fit between a top edge at a first end of the plastic outsert and the second portion of the outward curl.

An aspect of the system includes the outward curl forming a gap between a tip of the outward curl at an end of the second portion and the metal sidewall. A further aspect of the system includes the gap varying in distance between the tip of the outward curl and the metal sidewall across a thickness of the tip of the outward curl. A further aspect of the system includes the plastic outsert having a first inner diameter at the first end that is smaller than a diameter of the neck encompassing the outward curl. A further aspect of the system includes the outward curl having a substantially circular profile. A further aspect of the system includes the plastic outsert having a plastic sidewall with a thread that extends from and wraps around the plastic sidewall. A distance the outward curl extends from the metal sidewall is substantially equal to a thickness of the plastic sidewall of the plastic outsert. A further aspect of the system includes the metal sidewall and the plastic outsert forming a preform configured to be formed into the neck of the container.

It is to be understood that both the foregoing general description and the following detailed description are exemplary and explanatory only and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

Figure 1:
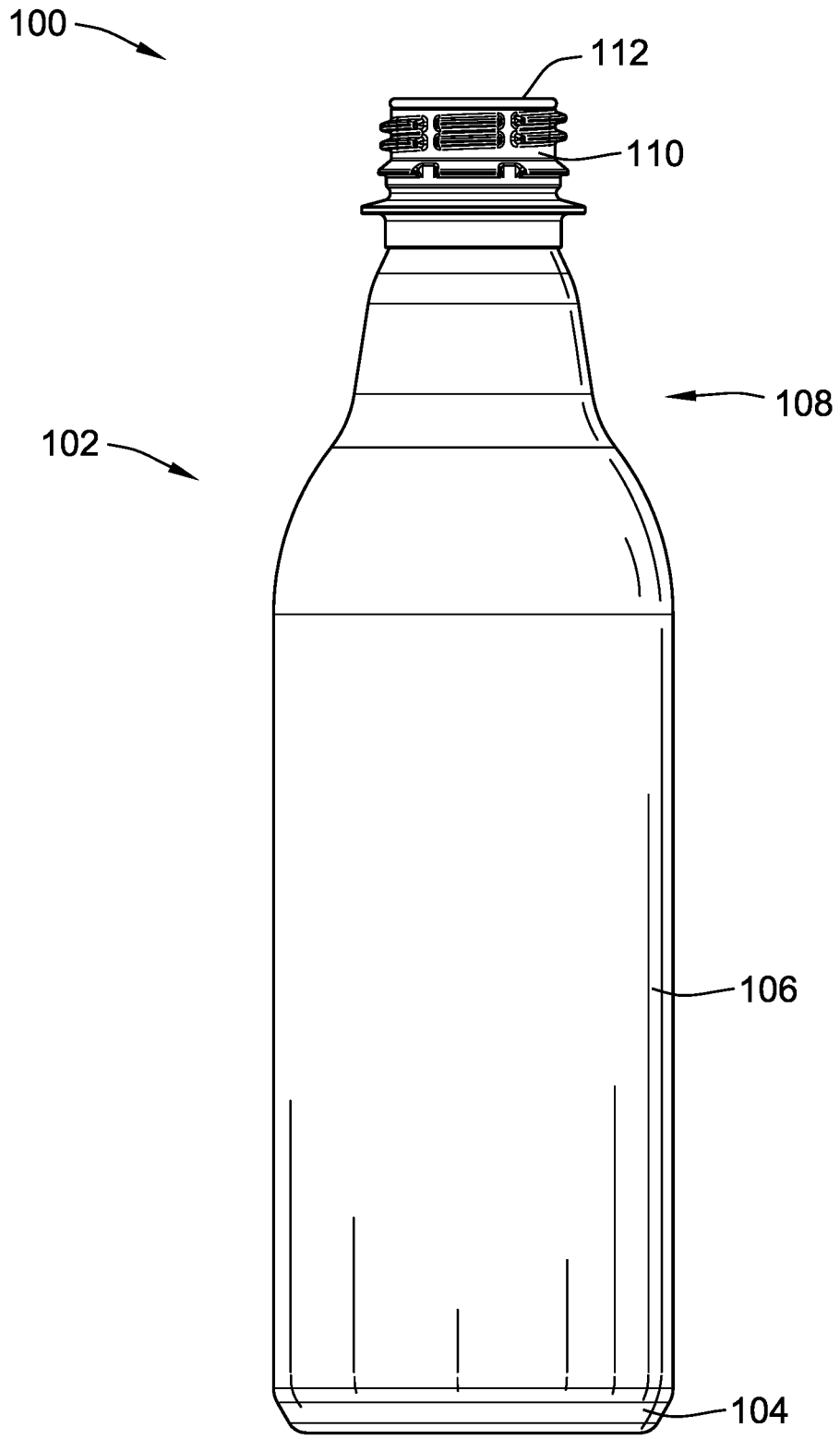
FIG. 1 is a side view of a metal container with an outsert, according to an embodiment of the present invention.

While the invention is susceptible to various modifications and alternative forms, specific forms thereof have been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention.

DETAILED DESCRIPTION

Objects of the present invention are directed to a metal container with an outsert, such as a plastic outsert, that can replace current containers formed substantially of plastic resins, such as PET, PVC, etc., and methods for making the metal container and outsert.

Referring to FIG. 1, FIG. 1 is a side view of a container 100, according to an embodiment of the present invention. The container 100 is formed of a metal body 102. The metal body 102 includes a base 104, a sidewall 106 that extends up from the base 104, and a neck 108 that extends up from the sidewall 106. Although the metal body 102 is illustrated as having a particular shape, the shape and dimensions of the metal body 102 can vary from what is illustrated in FIG. 1. The metal body 102 can be formed of various metals commonly used in forming containers, such as aluminum.

The neck 108 is generally tapered and includes an outsert 110. The outsert 110 can be formed of various materials commonly used in forming containers, such as a plastic resin (e.g., PET, PVC, etc.). Thus, although generally described as being an outsert throughout, the outsert 110 is a plastic outsert. As described in detail below, the outsert 110 is retained on the neck 108, at least in part, by a curl 112 formed in the neck 108 and an interference fit at an interface between the outsert 110 and the neck 108.

Although the processes are described below as applying to a container and/or a metal body, such as the container 100 and metal body 102, in one or more embodiments, the container 100 and/metal body can instead be a preform of a container or metal body, which can be formed into and/or used in the process of forming a completed container. For example, the processes described below, and the container 100 illustrated in FIG. 1, can instead be a container preform that can include only the neck 108 and the outsert 110, and can exclude one or both of the base 104 and the sidewall 106. In which case, one or both of the base 104 and the sidewall 106 can be formed after securing the outsert 110 on the neck 108.

Depending on the desired final dimensions and/or geometry of the container 100, the dimensions of the base 104, the sidewall 106, and/or the neck 108 can vary. According to some embodiments, the thickness of the sidewall forming the neck 108 can be about 0.08 millimeters (mm) to about 0.36 mm for a container that is from about 7 cm to about 28 cm. However, the foregoing dimensions of the container 100 are exemplary and are not limiting.

Figure 2:
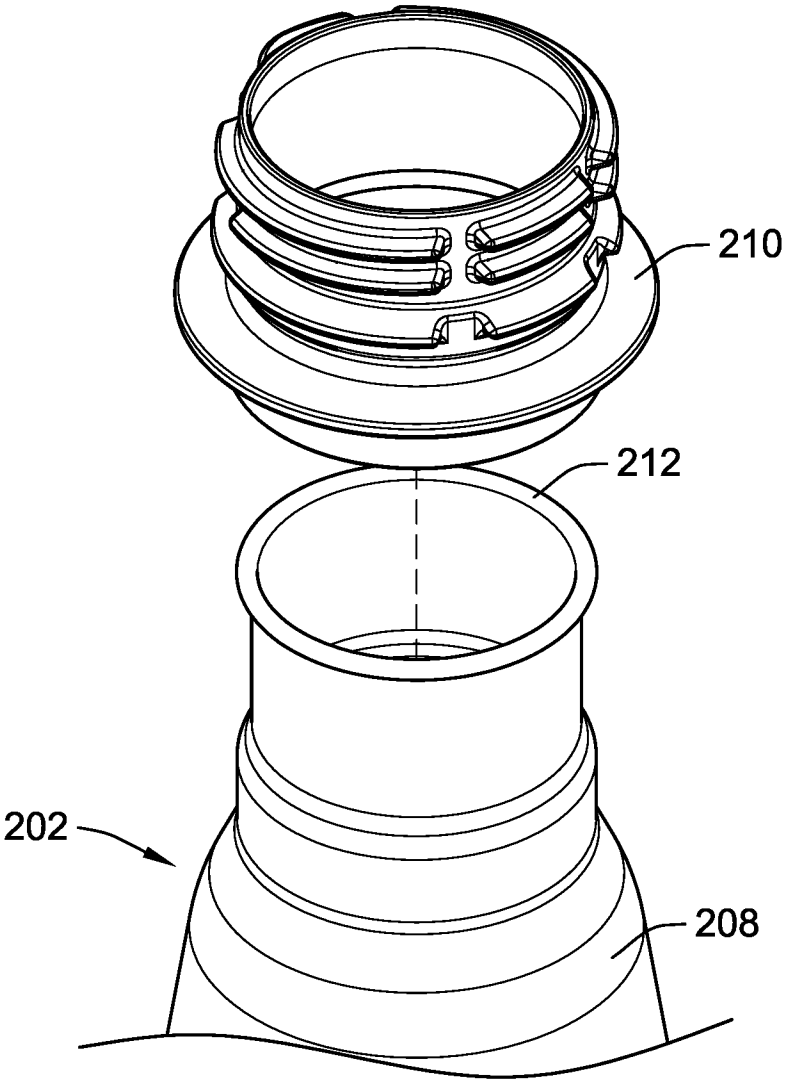
FIG. 2 is a partial schematic view of an outsert being slid onto a neck of the metal container, according to an embodiment of the present invention.

Referring to FIG. 2, FIG. 2 is a partial schematic view of an outsert 210 being slid down onto a neck 208 of a metal body 202, according to an embodiment of the present invention. Features with element numbers in FIG. 2 that end in the same ten's and one's digits as the element numbers in the foregoing figure correspond to similar features as in the foregoing figure. As illustrated, the curl 212 is formed in the neck 208 prior to the outsert 210 being retained on the neck 208. Thus, the outsert 210 is slid down onto the neck 208 over and past the curl 212. The profile of the curl 212 allows the outsert 210 to be assembled through a "jumping" process, where the outsert 210 "jumps" the curl 212. As described in greater detail below, the geometry of the curl 212 is configured to prevent collapsing and/or permanent deformation of the curl 212 while in contact with the outsert 210 and to prevent any permanent damage to the outsert 210 due to expansion of material during assembly.

The curl 212 can be formed according to any one or more conventional container manufacturing process steps, such as any conventional curling step. However, the curl 212 is formed prior to the application of the outsert 210. Forming the curl 212 and then applying the outsert 210 reduces a likelihood of a space being between the outsert 210 and the curl 212, which would prevent or reduce the effectiveness of an interference fit that forms at an interface between the curl 212 and the outsert 210, as described further below. Forming the curl 212 can reduce the overall height of the final container by about 1.2 mm to about 7.6 mm. Accordingly, the neck 208 is formed to be an additional about 1.2 mm to about 7.6 mm tall to accommodate forming the curl 212 with a height of about 1.3 mm to about 2.3 mm.

The outsert 210 can be applied to the neck 208 by various tools and/or machinery that can apply the necessary force to cause the curl 212 to flex, as described below, without causing, or at least minimizing, permanent deformation to the neck 208, the outsert 210, and/or the curl 212.

Figure 3:
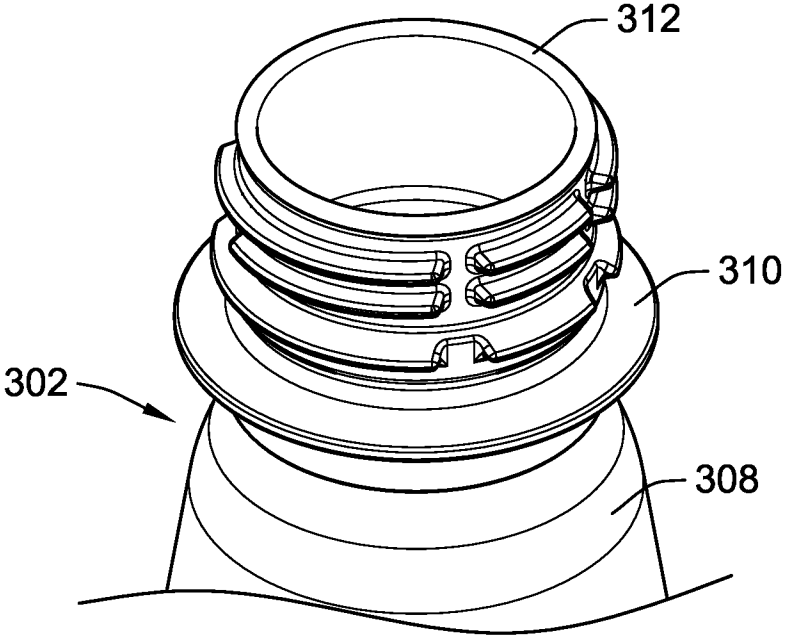
FIG. 3 is a partial schematic view of an outsert retained on a neck of a metal container, according to an embodiment of the present invention.

Referring to FIG. 3, FIG. 3 is a partial schematic view of an outsert 310 retained on a neck 308 of a metal body 302, according to an embodiment of the present invention. Features with element numbers in FIG. 3 that end in the same ten's and one's digits as the element numbers in the foregoing figures correspond to similar features as in the foregoing figures. The top edge (illustrated and described below in FIGS. 4D and 5) of the outsert 310 is below and forms an interference fit with the curl 312 of the neck 308. As described in greater detail below, the interference fit that forms at an interface between the top edge of the outsert 310 and the curl 312 retains the outsert 310 on the neck 308 of the metal body 302.

Figure 4A:
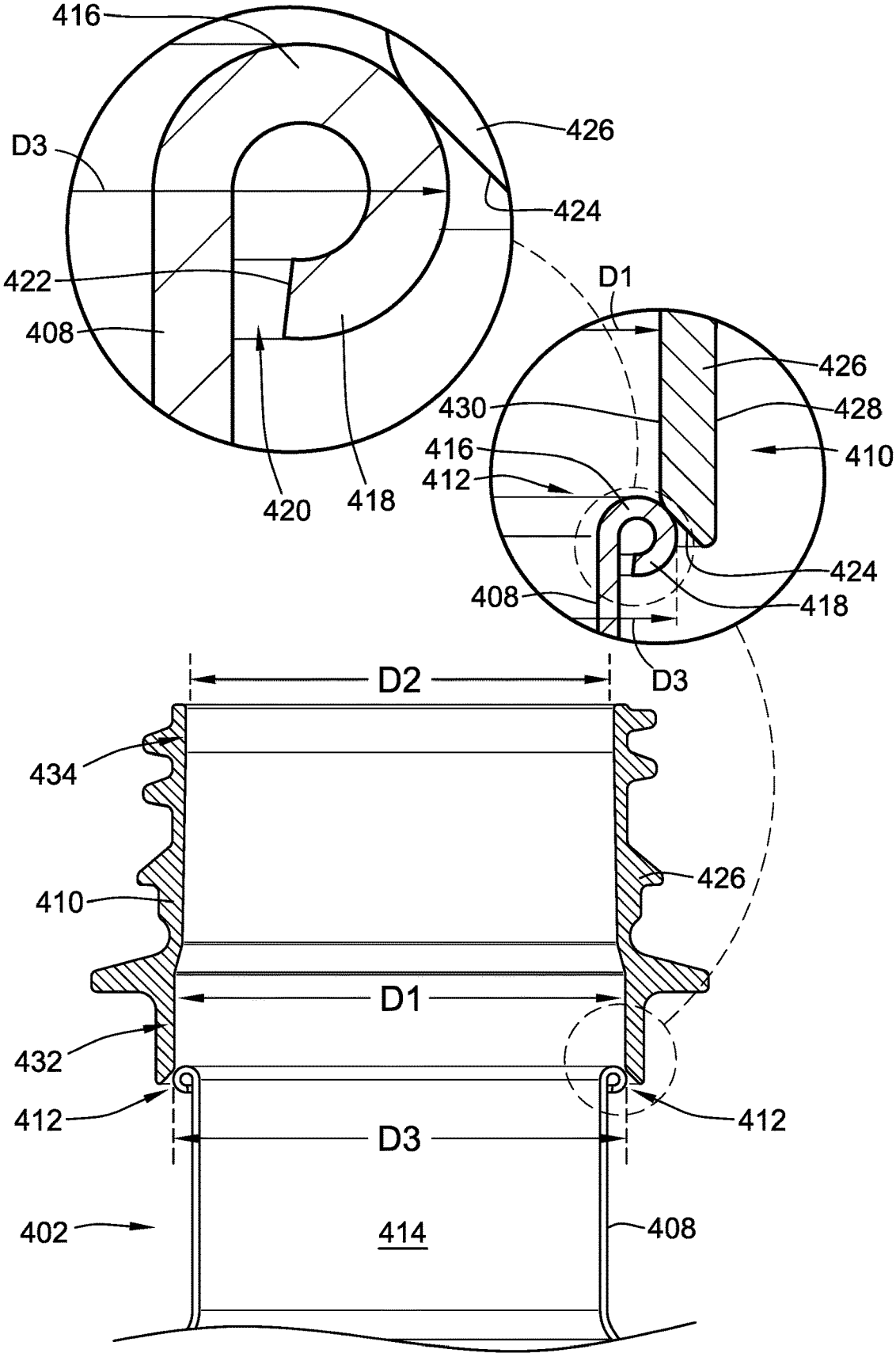
FIG. 4A is a partial cross-sectional view of step of a process of sliding an outsert down onto a neck of a metal container, according to an embodiment of the present invention.

Referring to FIGS. 4A-4D, illustrated is a process for fixing an outsert 410 on a neck 408 of a metal body 402, according to embodiments of the present invention. FIG. 4A is a partial cross-sectional view of one step of the process of sliding the outsert 410 down onto the neck 408 of the metal body 402, according to an embodiment of the present invention. Features with element numbers in FIG. 4A that end in the same ten's and one's digits as the element numbers in the foregoing figures correspond to similar features as in the foregoing figures. The illustrated step in FIG. 4A is when the outsert 410 first contacts the curl 412 in the neck 408.

The curl 412 is an outward curl. The term "outward" describes how the metal sidewall at the top of the neck 408 that forms the curl 412 initially curls away from the interior 414 of the neck 408. Referring to the detailed view in FIG. 4A, the outward curl 412 includes a first section 416 that extends away from the interior 414 of the neck 408. The curl 412 further includes a second section 418 that curls back towards the neck 408. The first section 416 and the second section 418 together define the curl 412 as having a substantially circular profile.

Referring to the further detailing view in FIG. 4A, the second section 418 of the curl 412 does not curl back around completely to the metal sidewall of the neck 408. Rather, the curl 412 defines a gap 420 between the tip 422 of the second section 418 of the curl 412 and the metal sidewall of the neck 408. As discussed further below, the gap 420 allows the curl 412 to flex as the outsert 410 slides down onto the neck 408. The gap 420 allows the outsert 410 to be applied to the neck 408 and allows the curl 412 to flex without causing, or at least minimizing, permanent deformation to the neck 408, the outsert 410, and/or the curl 412.

Referring back to the outsert 410 in the detailed view in FIG. 4A, a leading edge 424 of the outsert sidewall 426 of the outsert 410 (i.e., outsert sidewall 426) can be tapered to assist in guiding the outsert 410 around the curl 412. The taper can be formed by having the thickness of the outsert sidewall 426 increase from the exterior side 428 to the interior side 430. However, in one or more embodiments, the leading edge 424 of the outsert sidewall 426 can instead be flat, or the taper can be formed by having the thickness of the outsert sidewall 426 increase from a point in the middle of the outsert sidewall 426 to the exterior side 428 and the interior side 430.

In one or more embodiments, the inner diameter of the outsert 410 can be constant (not shown) such that the outsert sidewall 426 does not have any steps and/or tapered sections, other than the tapered edge 424 (if present). However, as illustrated in FIG. 4A, the outsert sidewall 426 can include more than one inner diameter. For example, the first end 432 of the outsert sidewall 426 can have an inner diameter D1. The second end 434 of the outsert sidewall 426 can have an inner diameter of D2. In one or more embodiments, and as illustrated in FIG. 4A, the inner diameter D1 can be larger than the inner diameter D2. Further, in one or more embodiments, the outsert sidewall 426 can include more than two inner diameters, such as three, four, five, six, etc., depending on the desired geometry of the outsert sidewall 426 and/or the desired geometry of the metal sidewall of the neck 408 that aligns to the outsert sidewall 426 with the outsert 410 retained on the neck 408.

Figure 4B:
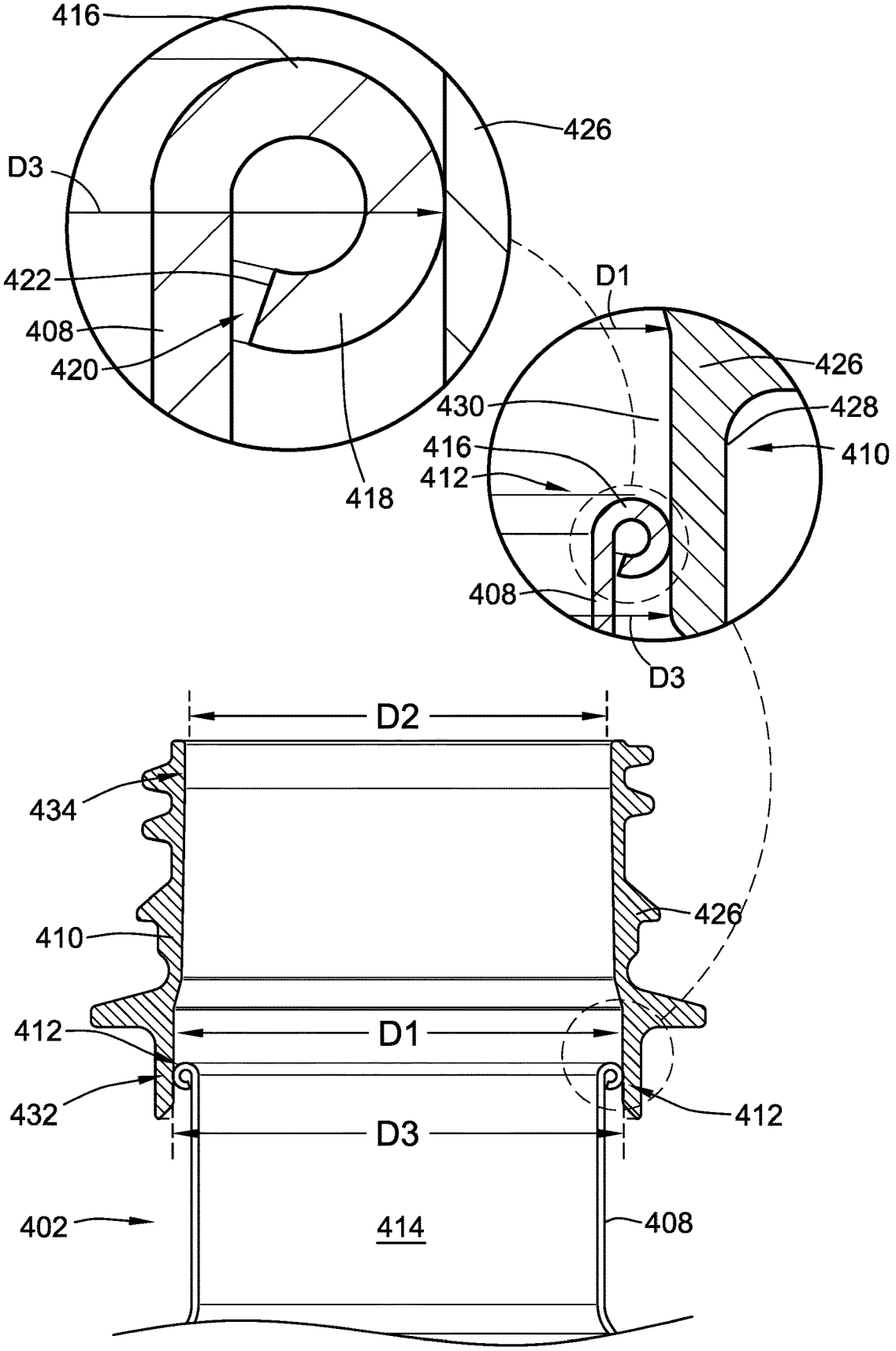
FIG. 4B is a partial cross-sectional view of another step of a process of sliding an outsert down onto a neck of a metal container, according to an embodiment of the present invention.

FIG. 4B is a partial cross-sectional view of another step of the process of sliding the outsert 410 down onto the neck 408 of the metal body 402, according to an embodiment of the present invention. Features with element numbers in FIG. 4B that end in the same ten's and one's digits as the element numbers in the foregoing figures correspond to similar features as in the foregoing figures. As the first end 432 of the outsert sidewall 426 slides or "jumps" over the curl 412, the curl 412 flexes. More specifically, and referring to the further detailed view of FIG. 4B, the first section 416 and the second section 418 of the curl 412 flex such that the tip 422 of the curl 412 approaches the sidewall of the neck 408 and the gap 420 decreases in width. The comparison between the further detailed views in FIGS. 4A and 4B illustrate how the gap 420 provides space for the curl 412 to flex for accommodating the outsert 410 sliding over the curl 412. The curl 412 must flex because the inner diameter D1 of the outsert 410 at the first end 432 is less than the diameter D3 of the neck 408 in combination (or encompassing) the curl 412. As a result, the diameter D3 of the neck 408 becomes the same as the inner diameter D1 of the first end 432 of the outsert 410 as the curl flexes.

Although the largest inner diameter (e.g., diameter D1) is described as being smaller than the diameter D3, in one or more embodiments, one or more inner diameters of the outsert 410 can be larger than the diameter D3. In which case, sliding the portion of the outsert 410 with an inner diameter larger than the diameter D3 does not contact and/or cause the curl 412 to flex. However, at least the end of the outsert that contacts the curl 412 (i.e., second end 434 in the illustrated embodiment) must have an inner diameter that is less than the diameter D3.

In one or more embodiments, the outsert 410 can be heat treated prior to sliding the outsert 410 onto the neck 408. For example, the outsert 410 can be heat treated so that the plastic resin that forms the outsert 410 is brought to a temperature of about 15° C. to about 60° C. The heat treatment can prevent or limit the permanent deformation that outsert 410 experiences when sliding onto the neck 408.

Figure 4C:
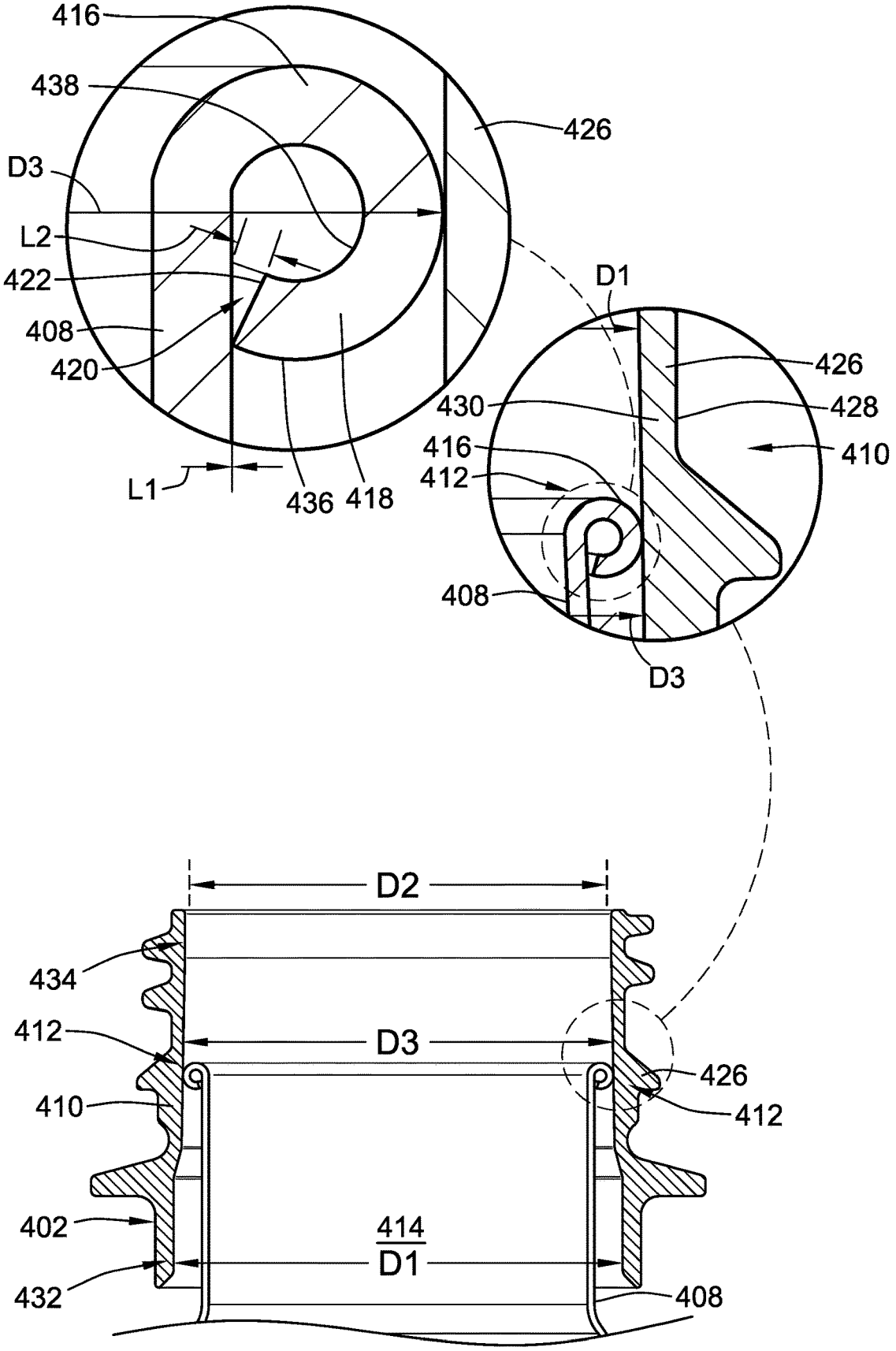
FIG. 4C is a partial cross-sectional view of another step of sliding an outsert down onto a neck of a metal container, according to an embodiment of the present invention.

FIG. 4C is a partial cross-sectional view of another step of the process of sliding the outsert 410 down onto the neck 408 of the metal body 402, according to an embodiment of the present invention. Features with element numbers in FIG. 4C that end in the same ten's and one's digits as the element numbers in the foregoing figures correspond to similar features as in the foregoing figures. As the second end 434 of the outsert sidewall 426 now slides over the curl 412, the curl 412 flexes even more. More specifically, and referring to the further detailed view of FIG. 4C, the first section 416 and the second section 418 of the curl 412 flex such that the tip 422 of the curl 412 further approaches the sidewall of the neck 408, or the tip 422 may even touch the sidewall of the neck 408 (as illustrated). With the tip 422 of the curl 412 touching the sidewall of the neck 408, the gap 420 may be removed, partially or completely. For example, and referring to the further detailed view of FIG. 4C, the tip 422 of the curl 412 can be flat but still have a distance relative to the sidewall of the neck 408 that varies. As a result, the gap 420 too can vary in width between the tip 422 of the curl 412 and the metal sidewall of the neck 408 across a thickness of the tip 422. Specifically, the exterior surface 436 of the curl 412 at the tip 422 can be a length L1 from the sidewall of the neck 408. The interior surface 438 of the curl 412 at the tip 422 can be a length L2 from the sidewall of the neck 408, with the length L2 being larger than the length L1 because of the flat tip 422. As a result, the interior surface 438 at the tip 422 may not touch the sidewall of the neck 408, and the exterior surface 436 at the tip 422 may touch the sidewall of the neck 408. This leaves the gap 420 remaining between the tip 422 and the sidewall of the neck 408, even with the curl 412 fully flexed to accommodate the outsert 410. However, other geometries of the tip 422 of the curl 412 are possible, such the tip 422 being tapered so that the distance between the tip 422 and the sidewall of the neck 408 is constant across the thickness of the tip 422.

Whatever the configuration of the tip 422 of the curl 412, the curl 412 flexes because the inner diameter D2 of the curl 412 at the second end 434 is less than the diameter D3 of the neck 408 in combination (or encompassing) the curl 412, when the curl 412 contacts the second end 434 of the outsert sidewall 426. As a result, the diameter D3 of the neck 408 becomes the same as the inner diameter D2 of the second end 434 of the outsert 410. Thus, the gap 420 allows the curl 412 to flex during outsert 410 application so as not to permanently deform the outsert 410.

Figure 4D:
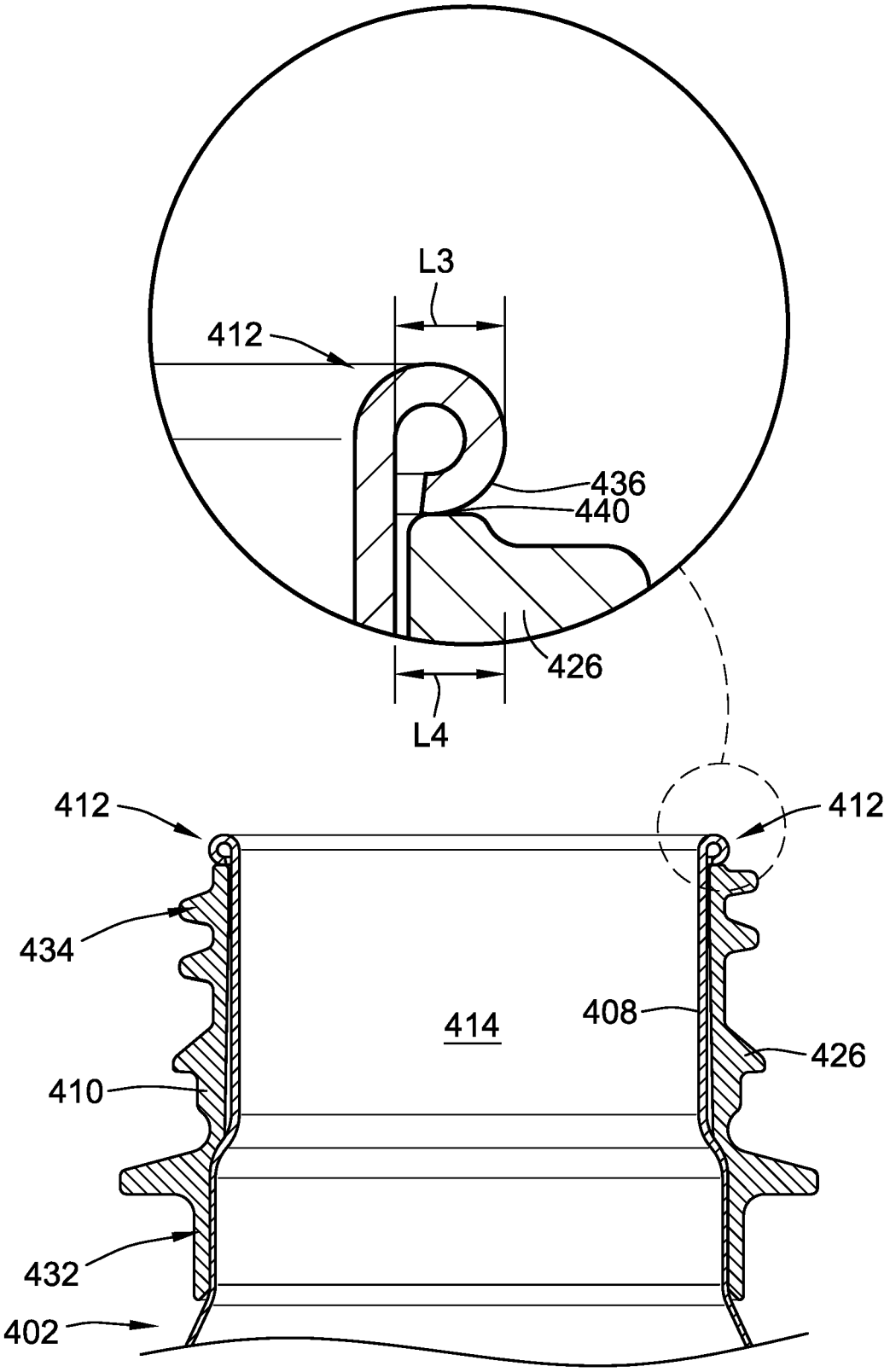
FIG. 4D is a partial cross-sectional view of another step of sliding an outsert down onto a neck of a metal container, according to an embodiment of the present invention.

FIG. 4D is a partial cross-sectional view of another step of the process of sliding the outsert 410 down onto the neck 408 of the metal body 402, according to an embodiment of the present invention. Features with element numbers in FIG. 4D that end in the same ten's and one's digits as the element numbers in the foregoing figures correspond to similar features as in the foregoing figures. At FIG. 4D, the outsert 410 is now retained, at least in part, by the curl 412. More specifically, and referring to the detailed view in FIG. 4D, the exterior surface 436 of the curl 412 contacts the trailing edge 440 of the outsert sidewall 426. At this point, the process of applying and retaining the outsert 410 on the neck 408 is complete.

The curl 412 extends from the neck 408 the length L3. A thickness of the outsert sidewall 426 is the length L4. In one or more embodiments, the length L3 can be greater than, less than, or substantially the same as the length L4. However, in embodiments where the length L3 is less than or substantially equal to the length L4, the curl 412 does not interfere with securing a closure (e.g., bottle cap) (not shown) or other aspects associated with processes that conventionally were limited to plastic resin containers, such as conveying a resulting container with the neck 408 and outsert 410 along an air conveyor channel.

Figure 5:
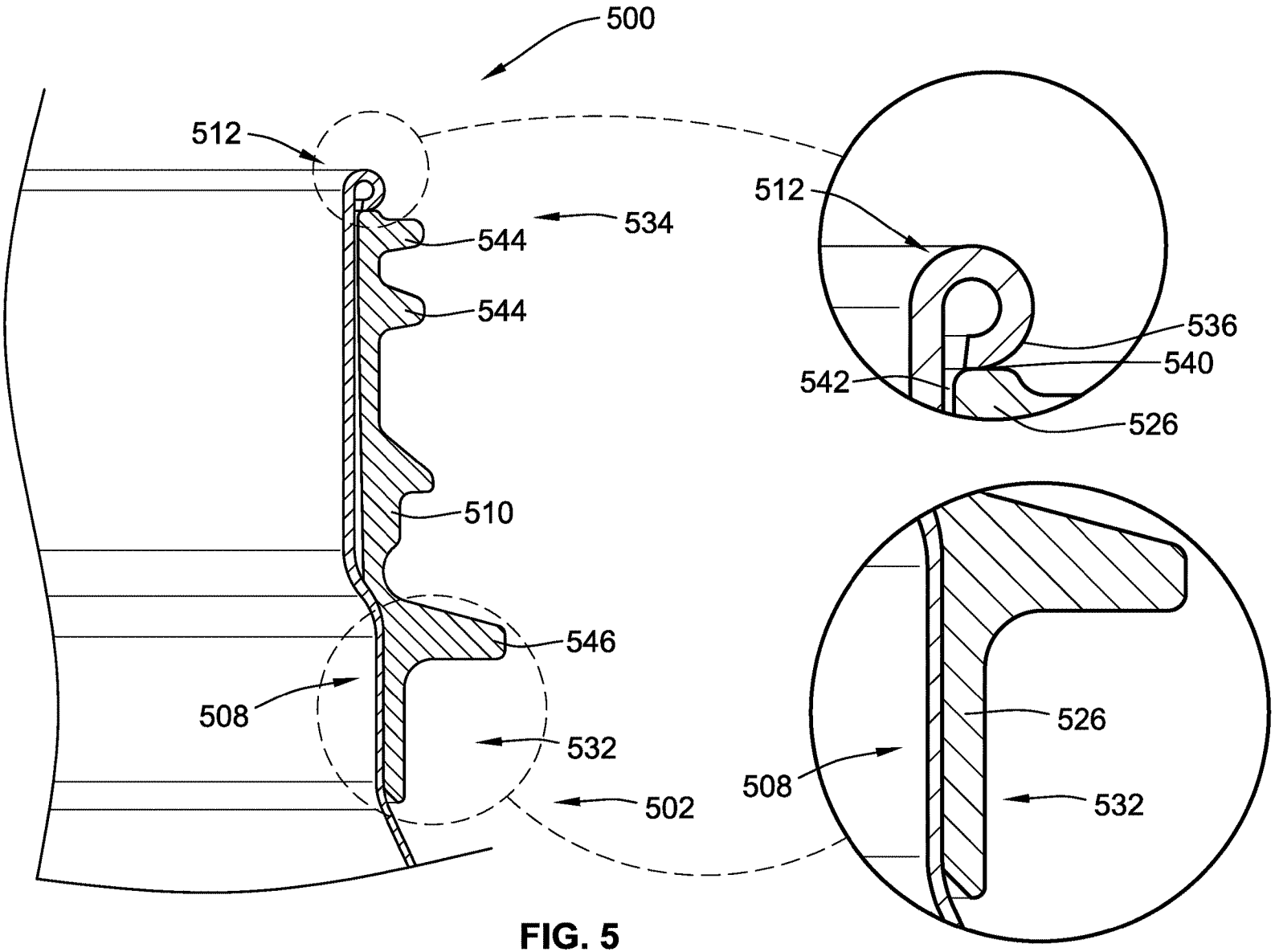
FIG. 5 is a partial cross-sectional view of outsert retained on a neck of a metal container, according to an embodiment of the present invention.

Referring to FIG. 5, FIG. 5 is a partial cross-sectional view of an outsert 510 retained on a neck 508 of a metal body 502, according to an embodiment of the present invention. Features with element numbers in FIG. 5 that end in the same ten's and one's digits as the element numbers in the foregoing figures correspond to similar features as in the foregoing figures. Similar to what is described above in relation to FIG. 4D, the outsert 510 is retained at the second end 534 by the curl 512. More specifically, and referring to the top detailed view in FIG. 5, the exterior surface 536 of the curl 512 contacts the trailing edge 540 of the outsert sidewall 526. The contact between the exterior surface 536 and the trailing edge 540 establishes a first interference fit that retains the outsert 510 on the neck 508. The first interference fit resists and/or prevents the outsert 510 from moving up or down relative to the neck 508.

In one or more embodiments, a gap 542 is formed between the outsert sidewall 526 and the sidewall of the neck 508. The gap 542 can prevent and/or reduce drag and/or assembly loads during application, such as loads of about 360 newtons (N). However, in one or more embodiments, the gap 542 can be omitted and the outsert sidewall 526 can instead contact the neck 508 at the second end 534.

Referring to the bottom detailed view of FIG. 5, the sidewall of the neck 508 contacts the outsert sidewall 526 at the first end 532. This contact between the neck 508 and the outsert sidewall 526 establishes a second interference fit that retains the outsert 510 on the neck 508. The second interference fit resists and/or prevents the outsert 510 from rotating relative to the neck 508, such as when a closure (not shown) is secured to, or removed from, the container 500. The second interference fit can also vertically position the outsert 510 relative to the neck 508. The second interference fit provides the ability of the combination of the outsert 510 on the neck 508 to achieve the same torque requirements as plastic resin containers, such as about 140 to about 210 kilopascals (kPa). The second interference fit also resists and/or prevents the outsert 510 from moving up or down relative to the neck 508, in combination with the first interference fit. In one or more embodiments, the second interference fit can be over an area of up to about 2.5 mm of contact between the first end 532 of the outsert 510 and the neck 508. Moreover, the presence of the outsert 510 does not substantially affect the performance of a resulting container 500. For example, a resulting container 500 with the outsert 510 can still withstand capping loads of about 450 to about 550 N, but the container 500 can withstand loads of up to about 1900 N before deformation of the curl 512 occurs.

The outsert 510 can include a thread 544 that extends from and wraps around the outsert sidewall 526. The thread 544 assists in securing a closure (e.g., bottle cap) (not shown) to the container 500. The outsert 510 can further include, or alternatively include, a carrier ring 546. The carrier ring 546 allows the container 500 (or container preform) to travel along conveyor systems used in the manufacturing, filling, capping, etc. processes for plastic bottles, despite the container 500 being substantially formed of metal. For example, containers formed according to the disclosed processes with the outsert 510 can be run in current PET or plastics filling and capping machinery. This is advantageous as containers formed according to the disclosed processes with the outsert 510 and/or the carrier ring 546 can be used in processing lines that have been designed for plastic containers having a carrier ring without needing to change or otherwise modify existing filling/capping machinery or setups for filling and/or capping containers historically made from PET or other plastics. Moreover, the presence of the curl 512 does not interfere or affect the final dimensions of the container 500, so that the container 500 still satisfies the industry standard "S" dimension (e.g., from the top of the curl 512 to the first full thread 544) to utilize current PET capping machinery. Here, too, this is advantageous as containers formed according to the disclosed processes with the outsert 510 and/or the carrier ring 546 can be used in processing lines designed for plastic containers having a carrier ring without needing to change or otherwise modify existing machinery or setups. Yet, the curl 512 accounts for a portion of the distance of the "S" dimension. Thus, the second end 534 above the thread 544 of the outsert 510 is reduced in height so as to accommodate the height of the curl 512 in the combination of the curl 512 and the outsert 510.

The containers and processes disclosed herein with a metal body and an outsert will allow the beverage industry to migrate from the use of plastic bottles to metal bottles and replace a majority of plastic bottles in bottle production lines. Moreover, the containers and processes of the present disclosure can improve the environment, by lessening the PET, PVC and others plastics footprints, and improve consumer safety, by removing plastic resins that potentially contain toxins that leach into the contained liquid, and subsequently into the human bloodstream. Moreover, these benefits can be achieved without filler plants needing to change or otherwise modify filling/capping machinery or setups for filling and/or capping containers.

Each of these embodiments and obvious variations thereof are contemplated as falling within the spirit and scope of the claimed invention, which is set forth in the following claims. Moreover, the present concepts expressly include any and all combinations and sub-combinations of the preceding elements and aspects.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments are intended to indicate that such embodiments are possible examples, representations, and/or illustrations of possible embodiments (and such terms are not intended to connote that such embodiments are necessarily extraordinary or superlative examples).

Any references herein to the positions of elements (e.g., "top," "bottom," "above," "below," etc.) are merely used to describe the orientation of various elements in the Figures. It should be noted that the orientation of various elements may differ according to other exemplary embodiments, and that such variations are intended to be encompassed by the present disclosure.

Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes, and omissions may also be made in the design, operating conditions, and arrangement of the various exemplary embodiments without departing from the scope of the present invention.

The invention claimed is:

1. A method comprising:

providing a neck for a metal body, the neck being formed of a metal sidewall;

forming an outward curl in the metal sidewall at a first end of the neck;

sliding a plastic outsert down onto the neck from the first end of the neck, the plastic outsert having a first inner diameter at a first end that is smaller than a diameter of the neck encompassing the outward curl, the outward curl flexing as the plastic outsert slides down onto the neck to accommodate the first end of the plastic outsert passing over the outward curl; and retaining the plastic outsert on the neck between a first interference fit at a first interface of the metal sidewall and the plastic outsert and at a second interference fit between a top edge of the plastic outsert at the first end of the plastic outsert and the outward curl.

2. The method of claim 1, wherein the forming the outward curl leaves a gap between a tip of the outward curl and the metal sidewall of the neck.

3. The method of claim 2, wherein the gap provides clearance for the outward curl to flex to accommodate the first end of the plastic outsert passing over the outward curl as the plastic outsert slides onto the neck.

4. The method of claim 2, wherein the gap varies in distance between the tip of the outward curl and the metal sidewall across a thickness of the tip of the outward curl.

5. The method of claim 1, wherein the outward curl has a substantially circular profile.

6. The method of claim 1, wherein the plastic outsert comprises a plastic sidewall with a thread that extends from and wraps around the plastic sidewall.

7. The method of claim 6, wherein a distance the outward curl extends from the metal sidewall of the neck is substantially equal to a thickness of the plastic sidewall of the plastic outsert.

8. The method of claim 6, wherein the plastic outsert comprises a carrier ring that wraps around the plastic sidewall below the thread.

9. The method of claim 8, wherein the retaining the plastic outsert on the neck results in a clearance between the metal sidewall of the neck and the first end of the plastic outsert.

10. The method of claim 1, wherein the plastic outsert has a second inner diameter at a second end, opposite the first end, that is smaller than the diameter of the neck encompassing the outward curl.

11. The method of claim 1, further comprising treating the plastic outsert with heat to reduce permanent deformation of the plastic outsert during the sliding the plastic outsert onto the neck.

12. The method of claim 11, wherein the internal temperature of the plastic outsert is raised to about 60° F. to about 140° F. during the treating the plastic outsert with heat.

* * * * *